US011716572B2

(12) United States Patent
Otto et al.

(10) Patent No.: US 11,716,572 B2
(45) Date of Patent: Aug. 1, 2023

(54) METHOD OF PRODUCTION OF AN ELECTRODYNAMIC ACOUSTIC TRANSDUCER WITH A HIGH DENSITY COIL

(71) Applicant: Sound Solutions International Co., Ltd., Beijing (CN)

(72) Inventors: Gustav Otto, Vienna (AT); Hong-Bi Dong Nguyen, Vienna (AT); Franz Heidinger, Unterwaltersdorf (AT)

(73) Assignee: Sound Solutions International Co., Ltd., Beijing (CN)

( * ) Notice: Subject to any disclaimer, the term of this patent is extended or adjusted under 35 U.S.C. 154(b) by 61 days.

(21) Appl. No.: 17/338,168

(22) Filed: Jun. 3, 2021

(65) Prior Publication Data

US 2021/0329385 A1 Oct. 21, 2021

Related U.S. Application Data

(62) Division of application No. 16/868,414, filed on May 6, 2020, now Pat. No. 11,418,886.

(30) Foreign Application Priority Data

May 6, 2019 (AT) ..... A 50404/2019

(51) Int. Cl.
*H04R 9/02* (2006.01)
*H04R 31/00* (2006.01)

(52) U.S. Cl.
CPC ..... *H04R 9/02* (2013.01); *H04R 31/00* (2013.01)

(58) Field of Classification Search
CPC ..... H04R 9/06; H04R 9/025; H04R 29/003; H04R 9/04; H04R 2207/00;
(Continued)

(56) References Cited

U.S. PATENT DOCUMENTS 6,421,449 B1 7/2002 Hasegawa et al.
6,741,152 B1 * 5/2004 Arz ..... H01F 27/2876 336/62

(Continued)

FOREIGN PATENT DOCUMENTS

CN 102379130 A 3/2012
CN 108668198 A 10/2018

(Continued)

OTHER PUBLICATIONS

Chinese Patent Office; First Office Action issued in counterpart application CN202010364708.0, dated Jun. 1, 2021, with English Translation.

(Continued)

*Primary Examiner* — Norman Yu
(74) *Attorney, Agent, or Firm* — Dykema Gossett PLLC

(57) ABSTRACT

A method for manufacturing an electrodynamic acoustic transducer is disclosed. The electrodynamic acoustic transducer comprises a frame and/or a housing, a membrane, at least one coil and a magnet system, wherein the coil, in a cross sectional view with a coil axis being part of the sectional plane, comprises a plurality of conductive layers formed by an electrical conductor of the coil. The electrical conductor has a rectangular cross section in said cross sectional view, wherein a longer side of the rectangular cross section is substantially perpendicular to the loop axis. According to this method, a stack of conductive layers is made from the electrical conductor by stacking of separate pieces of the electrical conductor and electrically connecting the stacked separate pieces and/or by folding of the electrical conductor.

12 Claims, 10 Drawing Sheets

(58) Field of Classification Search
CPC ..... H04R 2209/00; H04R 9/047; H04R 9/00; H04R 9/02; H04R 31/00
USPC ..... 381/59, 150, 396, 185, 400–412
See application file for complete search history.

(56) References Cited

U.S. PATENT DOCUMENTS

| | | | | |
|---|---|---|---|---|
| 2004/0071308 | A1 | 4/2004 | Guenther | |
| 2006/0039578 | A1 | 2/2006 | Stiles et al. | |
| 2011/0249859 | A1* | 10/2011 | Lee | H04R 9/04 381/400 |
| 2013/0221455 | A1* | 8/2013 | Manack | G01J 5/12 257/431 |
| 2015/0350791 | A1* | 12/2015 | Yang | H04R 9/06 381/399 |
| 2018/0279052 | A1 | 9/2018 | Reining | |
| 2018/0342789 | A1* | 11/2018 | Jiang | H01Q 1/528 |

FOREIGN PATENT DOCUMENTS

| | | | |
|---|---|---|---|
| EP | 0377143 | * | 7/1990 |
| EP | 3288287 | A1 | 2/2018 |
| JP | H06327096 | A | 11/1994 |

OTHER PUBLICATIONS

Chinese Patent Office; Search Report issued in counterpart application CN202010364708.0, dated May 18, 2021, with English Translation.

United States Patent and Trademark Office; First Office Action issued in counterpart application U.S. Appl. No. 16/868,414, dated Aug. 6, 2021.

* cited by examiner

METHOD OF PRODUCTION OF AN ELECTRODYNAMIC ACOUSTIC TRANSDUCER WITH A HIGH DENSITY COIL

PRIORITY

This patent application is a divisional of U.S. patent application Ser. No. 16/868,414, filed May 6, 2020, which claims priority from Austrian Patent Application No. A50404/2019, filed on May 6, 2019, the disclosures of all of which are incorporated herein, in their entirety, by reference.

BACKGROUND a. Technical Field

The invention relates to an electrodynamic acoustic transducer, which comprises a frame and/or a housing, a membrane fixed to said frame or said housing, at least one voicecoil or coil and a magnet system. The at least one coil is attached to the membrane and has an electrical conductor in the shape of loops running around a coil axis in a loop section. The magnet system is designed to generate a magnetic field transverse to the conductor in the loop section. Moreover, the invention relates to a method of manufacturing an electrodynamic acoustic transducer of said kind.

b. Background Art

An electrodynamic acoustic transducer and its production method are generally known in prior art. Unfortunately, known electrodynamic acoustic transducers and the known manufacturing methods suffer from a number of restrictions and drawbacks.

Generally, coils are made up from a coil wire, which is wound around a coil axis multiple times. Unfortunately, such coils are limited to shapes with a minimum radius. Accordingly, wound coils are circular or oval or have a comparably large corner radius in case a polygonal coil is wound. Generally, the winding process does not allow for concave or convex outer shapes and sharp corners. This limits the design freedom for the magnet system, too, since the design of the magnet system goes hand in hand with the design of the coil. For cost reasons, a polygonal magnet system regularly is built up from a number of singular, linear magnets. However, this means that there is no substantial magnetic flux in a bow section of a polygonal coil. The higher the corner radius has to be owing to the production process, the lower is the share of the coil which is flown trough by the magnetic field lines. That means that any corner radius lowers the sound pressure level in relation to the current flowing through the coil, in other words the efficiency of the electrodynamic acoustic transducer.

In addition, wound coils usually suffer from a shape change and size change after production. They may get a belly-shape or bone-shape, and they may get smaller after the winding is completed. The reason is the tensile stress in the wire, which is needed to wind a coil and which is released after winding. Because of the shape change and the size change, the air gap between the magnet system and the coil is made comparably wide so as to allow a compensation of the shape change and the size change.

Moreover, a fill factor, which is the share of the wire on the volume of the coil is comparably low thus offering a poor power weight ratio of a coil. In other words, an electrodynamic acoustic transducer offering a particular sound power is comparably voluminous and heavy what in view of mobile devices is very disadvantageous. The share on the volume of the coil apart from the wire's share is devoted to isolation and bonding and is effectively dead space and dead mass. Unfortunately, the weight of the coil does not just influence the overall weight of the electrodynamic acoustic transducer, but even more important the moving mass of the acoustic system. Hence, sound quality of known electrodynamic acoustic transducers is comparably poor. It should be noted that the dead space is not just caused by the geometry of the wire, but also by the fact that a number of wire turns are arranged in a single layer. Accordingly, the voltage drop between two layers is considerably high, and the insulation layer has to withstand this voltage drop. Hence, the insulation layer is comparably thick in case of coils made up from a coil wire.

Moreover, the process of connecting the membrane to a coil made up from a wire is usually linked to the use of a liquid adhesive, which is needed to bridge the varying gap width caused by the round surface of the wire. Generally, adhesion between the coil and the membrane is comparably low because of the small contact area between the membrane and the wire. As such, life time of the electrodynamic acoustic transducer, into which a wire coil is incorporated, may be limited considerably.

There are also electrodynamic acoustic transducers for which a metal foil is used as an electrical conductor of the coil. For example, EP 0 377 143 A2 discloses a coil, which comprises foil layers arranged in parallel with the coil axis. That means, that the longer side of the rectangular cross section of a layer is arranged in parallel with the coil axis. The metal foil is wound around a coil axis quite similar to the way a wire is wound around a coil axis. Again, the design is limited to convex outer shapes and round corners. A major drawback of this design appears when it comes to comparably thin coils, i.e. coils which are much higher than the width of the ring formed by the coil is. To achieve a desired number of turns which is needed to obtain a desired level of the Lorentz force, the foil must be comparably thin. This leads to substantial problems in the winding process and to poor power weight ratio. The reason is that thin foils mean a bad ratio between the thickness of the foil and the thickness of an insulation between the foils, which has to have a particular thickness in any case because of a desired electrical strength and also because of a desired mechanical strength. In other words, the insulation cannot be made arbitrarily thin. In turn, again the moving mass of such an acoustic system is comparably high in view of the sound pressure provided by said system.

SUMMARY OF THE INVENTION

On the above grounds, it is an object of the invention to overcome the drawbacks of the prior art and to provide an improved design for an electrodynamic acoustic transducer and an improved method of manufacturing such an electrodynamic acoustic transducer. In particular, this improved design shall provide as much as possible design freedom for the coil and the magnet system, low shape and size change after the production process if there is any at all and a very high power weight ratio.

The problem of the invention is solved by an electrodynamic acoustic transducer as defined in the opening paragraph, wherein (1) the coil in a cross sectional view with the coil axis being part of the sectional plane comprises a plurality of conductive layers formed by the electrical conductor with insulation layers in between, and the conductor of the coil has a rectangular cross section in said cross sectional view, wherein an angle between a longer side of the rectangular cross section and the loop axis is in a range of 80° to 100°.

In other words, an angle between a longer side of the rectangular cross section (i.e. its width) and a field line of the magnetic field through said conductor or between said longer side and the membrane of the electrodynamic acoustic transducer is in a range of −10° to +10°. That means, the longer side of the rectangular cross section is substantially perpendicular or even perpendicular to the loop axis or substantially parallel or even parallel to a field line of the magnetic field through said conductor or to the membrane of the electrodynamic acoustic transducer.

Moreover, the sectional plane, in which the coil is viewed, is perpendicular to a longitudinal extension of the electrical conductor or perpendicular to a direction of a current flowing through the electrical conductor.

The problem of the invention is also solved by a method of manufacturing an electrodynamic acoustic transducer with a frame and/or a housing, a membrane fixed to said frame or said housing, at least one coil, which is attached to the membrane and which has an electrical conductor in the shape of loops running around a coil axis in a loop section, and a magnet system being designed to generate a magnetic field transverse to the conductor in the loop section, comprising the steps of:

a) cutting the electrical conductor out of a metallic foil;
b) forming an insulation layer on the electrical conductor;
c) making a stack of conductive layers from the electrical conductor by (1) stacking of separate pieces of the electrical conductor and electrically connecting the stacked separate pieces, and/or (2) folding of the electrical conductor, and
d) (mechanically) connecting the conductive layers to each other by means of an adhesive.

By means of the above measures, coils with nearly any shape can be manufactured by cutting out a corresponding piece of a metallic foil. In particular, very sharp corners can be made in case of polygonal structures. In contrast, this is not possible when a wire or foil is wound to form a polygonal coil because a comparably large radius is needed in each corner as explained before. Since the design of the magnet system goes hand in hand with the design of the coil, the proposed measures also substantially increase the possibilities to make a magnet system. This is of particular advantage if a polygonal magnet system is built up from a number of singular, linear magnets because on the ground of the sharp corner radius, substantially the whole length of the electrical conductor of the coil is flown trough by the magnetic field lines. That means that the sound pressure level in relation to the current flowing through the coil is very high, in other words the efficiency of the electrodynamic acoustic transducer, is very high.

Moreover, no particular tensile stress is needed within a conductive layer during the proposed production procedure. In particular, a tensile stress in the electrical conductor can be kept below 50 $N/mm^2$ during steps a) to d). In this way, a substantial shape change and size change can be avoided. Because there is no substantial shape and size change, also the air gap between the magnet system and the coil can be made very small since the magnet system can be produced with low tolerances nowadays already. By these measures, the efficiency of the electrodynamic acoustic transducer is improved even more.

In addition, the proposed method provides coils with a high density of the electrical conductor. Preferably, a fill factor, which is the share of all conductive layers on the volume of the coil is >80%. Other solutions, like coils with a coil wire or horizontally stacked layers provide a fill factor, which is much lower (often below 70%), thus downgrading the power weight ratio of a coil. In other words, the proposed electrodynamic acoustic transducer offers more sound power at the same weight. As explained before, the weight of the coil does not just influence the overall weight of the electrodynamic acoustic transducer, but even more important the moving mass of the acoustic system. Hence, a substantial weight loss of the coil does also substantially influence the sound quality of the electrodynamic acoustic transducer. It should be noted that the insulation layer can be made comparably thin because there is just one turn per layer in the proposed coil, and the voltage drop between two layers is relatively low. The reduced thickness of the insulating layer in a foil coil as compared to a wire coil aids in increasing the fill factor.

Moreover, the process of connecting the membrane to a coil made up from a foil is not necessarily linked to the use of a liquid adhesive. Instead, also adhesive tapes may be used to attach the coil to the membrane since the foil coil offers an adhesive gap with constant width. This permits greater adhesion between the coil and the membrane because of the larger contact area. As such, the connection between the coil and the membrane is improved leading to longer service life of the electrodynamic acoustic transducer, into which the foil coil is incorporated.

The metal foil used for the electrical conductor of the coil can be made up of copper, aluminum, and any copper alloy or aluminum alloy for example. Preferably, the thickness of a conductive layer is 10-30 μm. In this way, a desired number of turns can be provided within a desired height of the coil. The thickness of an insulation layer preferably is 1-5 μm. In this way, electric strength is high enough to withstand a voltage difference between the conductive layers, and the mechanical stability is high enough to withstand the forces applied to the coil during use, both without substantially decrease the favorable power weight ratio of the coil. Generally, it is of advantage if the ratio between the longer side of the rectangular cross section and the smaller side of the rectangular cross section is >4. In this way, a preferred aspect ratio of the coil can be achieved along with a desired number of turns. From the perspective of this point in time, a metal seems to be most useful for the production of coils. However, the proposed method applies to conductive foils in general. So, the term "metal foil" may mentally be replaced by the term "conductive foil" throughout this text, if a material different to a metal, but with comparable or better conductivity is provided. It should also be noted that the aforementioned ratio is not necessarily constant, but may vary along the course of the electrical conductor if the width and/or the thickness of the electrical conductor is varied.

It should be noted that steps a) to d) do not necessarily imply a particular sequence of production steps. For example, step c) may implicitly take place when the conductive layers are connected to each other by means of an adhesive without the need of forming an insulation layer on the electrical conductor in a separate step. It should also be noted that mechanically connecting the conductive layers to each other by means of an adhesive in step d) does not necessarily follow the step of electrically connecting the stacked separate pieces in step c), but the electrical connection can follow the mechanical connection. In this context it should also be noted that a mechanical connection means a substantial connection of the conductive layers, in particular on an area of >50% of the area between two conductive layers. Strictly speaking, an electrical connection is also a mechanical connection, but it usually does not substantially enhance the stability of the layer construct. Further on, cutting the electrical conductor out of a metallic foil in step a) may also take place after the conductive layers have been connected to each other by means of an adhesive in step d).

Furthermore, it should be noted that folding the electrical conductor is different to wind an electrical conductor. "Folding" means bending the (flat) electrical conductor by 180° so that again a flat structure is formed. "Winding" means bending an electrical conductor continuously so that a round coil is formed or making ongoing bends of <180° in the same direction so that a polygonal coil is formed. Generally, folding the electrical conductor may be done by hand, by machine or by a combination of both.

It should also be noted that stacking of separate pieces of the electrical conductor and electrically connecting the stacked separate pieces as well as folding of the electrical conductor to make a stack of conductive layers from the electrical conductor can be used in any desired combination. Thus, a stack of conductive layers can be built up only by unfolded separate pieces of the electrical conductor, only by folded separate pieces of the electrical conductor (or even by just one folded piece) and in a mixed fashion by unfolded and folded separate pieces of the electrical conductor.

The proposed design applies to speakers in general and particularly to micro speakers, whose membrane area is smaller than 600 $mm^2$ and/or whose back volume is in a range from 200 $mm^3$ to 2 $cm^3$. Such micro speakers are used in all kind of mobile devices such as mobile phones, mobile music devices, laptops and/or in headphones. It should be noted at this point, that a micro speaker does not necessarily comprise its own back volume but can use a space of a device, which the speaker is built into, as a back volume. That means the speaker does not comprise its own (closed) housing but just an (open) frame. The back volume of the devices, which such speakers are built into, typically is smaller than 10 $cm^3$.

The electrodynamic acoustic transducer may comprise a frame and/or a housing.

A "frame" commonly is a part, which holds together the membrane, the coil and the magnet system. Usually, the frame is directly connected to the membrane and the magnet system (e.g. by means of an adhesive), whereas the coil is connected to the membrane. Hence, the frame is fixedly arranged in relation to the magnet system. Normally, the frame together with the membrane, the coil and the magnet system forms a sub system, which is the result of an intermediate step in a production process.

A "housing" normally is mounted to the frame and/or to the membrane and en-compasses the back volume of a transducer, i.e. an air or gas compartment behind the membrane. Hence, the housing is fixedly arranged in relation to the magnet system. In common designs, the housing can be hermetically sealed respectively air tight. However, it may also comprise small openings or bass tubes as the case may be. Inter alia by variation of the back volume respectively by provision of openings in the housing, the acoustic performance of the transducer can be influenced.

A "conductive layer" is a layer of the coil which is able to conduct a substantial level of an electric current. In this invention, a conductive layer is made from metal. It should be noted at this point that a "stack of conductive layers" does not exclude the existence of other layers between conductive layers, what in particular refers to "insulation layers", "passivation layers" and/or "adhesive layers".

An "insulation layer" is a layer of the coil which withstands a substantial level of a voltage and is not able to conduct a substantial level of an electric current. Examples for materials, which can be used to build up an insulation layer, are plastic materials, ceramics and oxides. An insulation layer can comprise a layer of a single insulating material, layers of different insulating materials, like the materials mentioned before, or a layer or more layers comprising a mixture of materials.

A "passivation layer" is a protective layer on the conductive layer. It may be generated by oxidation of the metal of the conductive layer. Accordingly, a passivation layer can comprise metal oxides. Usually, passivation layers have insulating characteristics. In this case, a passivation layer is part of the insulation layer. The generation of an passivation layer is optional, and the insulation layer may also built up without a passivation layer.

An "adhesive layer" is a layer, which mechanically connects two adjacent layers by adhesion. An adhesive layer usually has insulating characteristics, too. In this case, an adhesive layer is also part of the insulation layer. So, an insulation layer generally may comprise a passivation layer and/or an adhesive layer. An adhesive layer can be made of glue (in particular of a liquid glue), which is applied onto a conductive layer or onto a passivation layer on a conductive layer, for example by spraying, pad printing or rolling. Liquid glue may also applied into a gap between two conductive layers or passivation layers. This glue is then sucked into the gap by means of capillary action. Liquid glue may comprise anaerobic or heat curing adhesives (e.g., epoxy, acrylic). The viscosity of the adhesive can be less than 1000 mPas. In some embodiments, the viscosity of the adhesive is less than 500 mPas or even less than 50 mPas. An adhesive layer may also be formed by a plastic foil, in particular by a single sided or double sided adhesive foil, which is applied onto a conductive layer or onto a passivation layer.

"Cutting" the electrical conductor out of a metallic foil in step a) may happen in a number of ways. For example, a laser, a water jet, plasma cutting, photo etching, a knife or punching may be used for performing the cutting step. Furthermore, the metallic foil can be cut piece by piece, or a number of layers is cut in a single step. In the latter case, the layers may be interconnected (mechanically and/or electrically) or not. Accordingly, other layers than conductive layers, in particular insulation layers, passivation layers and/or adhesive layers may be cut at the same point in time.

Further advantageous embodiments are disclosed in the claims and in the description as well as in the figures.

In an advantageous embodiment of the electrodynamic acoustic transducer, a dimension of the coil may vary along the coil axis. In particular, the length of the shorter side of the rectangular cross section of the electrical conductor (i.e. the thickness of the conductive layer) and/or the length of the longer side of the rectangular cross section of the electrical conductor (i.e. the width of the conductive layer) and/or the horizontal position of a center of the longer side of the rectangular cross section of the electrical conductor varies along the coil axis.

For example, convex or concave side surfaces with nearly any desired profile can be generated when the width of the conductive layer and/or horizontal position of the conductive layer is varied. Varying the width of the conductive layer can be used to provide a (substantially) constant cross sectional area of the electrical conductor and thus a (substantially) constant current density in the electrical conductor throughout the height of the coil if the thickness of the conductive layer is varied along the coil axis. The term "substantially" in particular means a deviation of ±10% from a nominal value. Generally, variation of the thickness of the conductive layer may also be used to provide coil terminals which are thicker than the normal coil layers. In other words, the thickness of a conductive layer forming an electrical connection of the coil is thicker than the thickness of an adjacent conductive layer then. A conductive layer forming an electrical connection of the coil can have only one adjacent conductive layer (if an outer terminal of the coil is provided) or can have two adjacent conductive layers (if an inner coil terminal is provided).

In particular, said variation of the length of the shorter side (i.e. the thickness of the conductive layer) of the rectangular cross section of the electrical conductor can also be done in a way that the driving force factor of the transducer is flattened compared to a coil with non-varied thickness of the electrical conductor. So, the proposed method is not just used to provide coils with a very high power weight ratio, but also to support generation of a desired course of the driving force factor and thus to provide an electrodynamic acoustic transducer with comparably low total harmonic distortion. For the linearity of the electrodynamic acoustic transducer a flat course of the driving force factor is desired. By variation of the coil dimensions along the coil axis, the course of the driving force factor can be made flatter compared to the course of the driving force factor for a coil with rectangular cross section and constant thickness of the conductive layers. In this way, other sophisticated methods to linearize the speaker like electronically influencing the input signal of the speaker can be omitted or just used to a less extent.

In the above context it is very advantageous, if the shorter side of the rectangular cross section of the electrical conductor (i.e. the thickness of the conductive layer) is longer in a center region of the at least one coil than in a distant region of the at least one coil and/or the longer side of the rectangular cross section of the electrical conductor (i.e. the width of the conductive layer) is shorter in a center region of the at least one coil than in a distant region of the at least one coil. In this way, a very good linearization of the driving force factor and of the electrodynamic acoustic transducer can be provided.

In yet another advantageous embodiment of the electrodynamic acoustic transducer, a conductive layer forms an electrical connection between the coil and a non-moving terminal of the electrodynamic acoustic transducer, i.e. a lead of the coil through which an electric signal is fed to the coil in operation of the electrodynamic acoustic transducer. Accordingly, the leads are integrally formed with the coil, and no further dedicated electrical connection between the coil and a non-moving terminal of the electrodynamic acoustic transducer like a wire is desired. Because the conductive layers are usually comparably thin on the grounds explained hereinbefore and because of the orientation of the longer side substantially parallel or even parallel to the membrane of the electrodynamic acoustic transducer, an excellent compliance of the connecting conductor in the direction of the coil axis and thus in the excursion direction of the membrane is provided. In other words, the leads are soft in the excursion direction of the membrane. That is why the electrical connection between the coil and a non-moving terminal of the electrodynamic acoustic transducer of the proposed kind does not substantially influence the movement of the membrane. In particular, said connection neither substantially influences the damping of the acoustic system, nor its spring constant. The leads of the improved coil may also be cut from the foil sheet during the same process step of cutting the electrical conductor for the loop section of the coil out of the foil blank. Additionally, the leads may be coated with a polyamide coating to improve fatigue and corrosion resistance of the leads. This coating process may take place before the cutting step or afterwards.

Advantageously, at least two conductive layers or loops are formed by a single piece of a metallic foil, which comprises a bending or fold between each two conductive layers, wherein the bending is arranged in a protrusion or jogged portion of the coil. When the electrical conductor is fold onto itself, a conductive structure is generated, which has twice the thickness of the electrical conductor. By the proposed measures, such a conductive structure is arranged outside of the course of electrical conductor which is actually desired for a particular coil geometry. That means, if a circular coil is needed, said conductive structure is arranged outside of this circle. If a polygonal coil is formed, said conductive structure is arranged outside of the course of the legs of the polygonal coil and so on. By the above measures, the flat and even layer structure is not deteriorated by portions in the course of the electrical conductor having twice the thickness because the electrical conductor is fold onto itself.

If at least two conductive layers or loops are formed by a single piece of a metallic foil, which comprises a bending between each two conductive layers, it is also of advantage if the longer side of the rectangular cross section is enlarged in the region of the bending in relation to a section of the at least two conductive layers outside of said bending and/or the at least two conductive layers are made up from aluminum and are hardened and annealed in the region of the bending. The folds in the electrical conductors can lead to an increased electrical resistance in the region of the folds what can impact the acoustic performance of the electrodynamic acoustic transducer. This resistance increase may be compensated by increasing the width of the electrical conductors in the region of the folding lines. In turn, a larger cross-sectional area for the electrical current to flow through is provided, which thus reduces the electrical resistance. However, if aluminum is used for the electrical conductors, it may be hardened and locally annealed in the region of the folds what reduces the electrical resistance as well. In this way, the width of the electrical conductors in the region of the folding lines does not need to be increased as there is little to no increase of the resistance as a result of the folding. A laser and in particular the same laser, which is used for cutting and/or welding, can be used to harden and anneal the electrical conductor in the region of the bending.

In an advantageous embodiment of the proposed method, the electrical conductor is cut out of an aluminum foil in step a) and a passivation layer, which is part of the insulation layer, is formed on the electrical conductor by exposing the electrical conductor to hot distilled or de-ionized water and/or to hot vapor of distilled or de-ionized water. In addition to its superior weight to conductivity ratio in comparison to copper, aluminum allows to form a passivation layer when placed in contact with hot water or hot water vapor. The hot water vapor oxidizes the aluminum, creating a layer of aluminum oxide hydroxide, which electrically isolates the aluminum surface. The generated layers are also known as "Boehmite" layers. This process of creating the Boehmite layer is a particular embodiment of a passivation process. By the proposed measures, the insulation layer can be produced by use of simple and nonhazardous means.

Preferably, a conductive layer is cut by means of a laser beam or a water beam in step a). In this way, the conductive layer may comprise very fine structures. If a laser is used to cut the electrical conductor out of a metallic foil in step a), no force is applied to the fragile piece of metal foil, and there is no risk of an unintended deformation of the conductive layer.

Beneficially, the separate pieces of the electrical conductor are electrically connected by means of laser welding or ultrasonic welding in step c). In this way, a helical structure of the electrical conductor can be generated from the separate pieces of the electrical conductor. In particular, welding can take place after an insulation layer has been formed on the electrical conductor in step b). However, welding can also take place after two conductive layers have been connected to each other by means of an adhesive. Preferably, the coil is built up layer by layer then, meaning that a conductive layer is glued to another conductive layer and then the welding takes places. In a next cycle a further conductive layer is glued to the stack and another welding step takes place. This procedure is repeated until the stack has a desired height or number of conductive layers. Generally, the same laser can be used for welding, which is also used for cutting the electrical conductor out of a metallic foil in step a).

In an advantageous embodiment of the proposed method, first the stack of conductive layers is made from the electrical conductor without an adhesive and then an adhesive is applied to the stacked electrical conductor. According to this embodiment, "dry" pieces of the electrical conductor are stacked forming small air gaps between the separate conductive layers. In a next step the adhesive is applied and sucked into the gap between the conductive layers by means of capillary action. In this way, the time for making the stack of conductive layers is not limited by the curing time of the adhesive. Moreover, the stack of conductive layers may be made in a very clean way.

In the above context, it is of advantage if superfluous adhesive is removed by means of a laser. In this way, no force is applied to the stack of conductive layers so that there is no risk of an unintended deformation of the coil. In particular, a laser can be used, which is different to that used for cutting the electrical conductor out of a metallic foil in step a).

Advantageously, a supporting structure connected to the electrical conductor by means of bars is cut out of the metallic foil in step a), and the supporting structure is removed from the electrical conductor after step d). Because of the small cross section of the electrical conductor, handling a single conductive layer may get tricky because of the flimsy structure. For this reason, a supporting structure connected to the electrical conductor by means of bars may be cut out of a metallic foil in step a). This supporting structure reduces or eliminates twisting or deformation of the electrical conductor when handling the same. For example, the supporting structure can comprise a frame, which is connected to the conductive layer by means of several bars. After step d), i.e. after the conductive layers have been interconnected mechanically by means of an adhesive thus stabilizing the layer structure and making the supporting structure superfluous, the supporting structure together with the bars is removed from the electrical conductor. This may be again done by means of a laser, or the bars are simply torn of from the electrical conductor. Preferably, the same laser can be used, which is also used for cutting the electrical conductor out of a metallic foil in step a).

In the above context, it is of advantage if the bars of adjacent conductive layers are located at different positions after step c) when viewed in a direction of the loop axis. In this way, the accessibility of the bars is improved so that removing them from the electrical conductor is eased. In particular, the bars can be removed piece by piece.

Beneficially, the coil is coated with an insulating material after step d). In this way, the coil is protected against short circuits and environmental influences.

In another advantageous variant of the proposed method, an indentation or groove is formed along a folding line, around which the electrical conductor is to be folded, before step c) and/or along a tear off line of a bar connecting the electrical conductor to a supporting structure. In this way folding the electrical conductor and/or tearing off the bar can be supported without the need of cut outs. For example, the indentation can be formed with a laser at low laser power, by etching or by embossing.

It should be noted at this point that the embodiments proposed in view of the method of manufacturing an electrodynamic acoustic transducer and the advantages obtained thereof equally apply to the electrodynamic acoustic transducer as such and vice versa.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
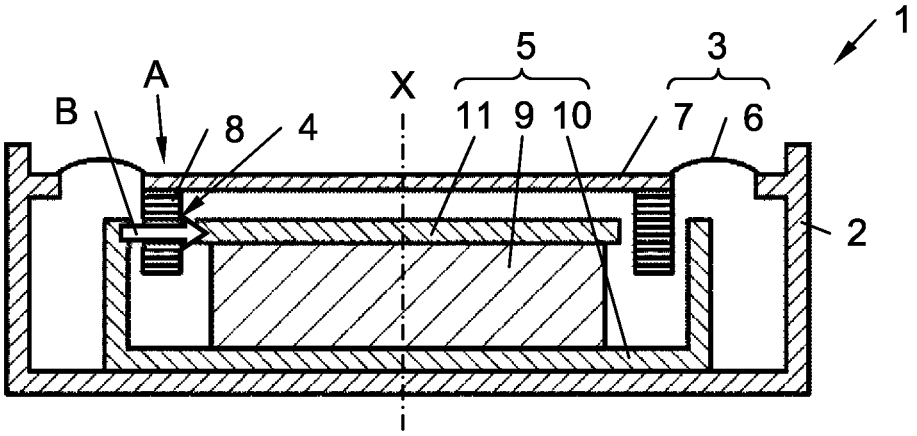
FIG. 1 shows a cross sectional side view of an exemplary electrodynamic acoustic transducer.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus", "minus", "upper", "lower", "upward", "downward", "left", "right", "leftward", "rightward", "front", "rear", "top", "bottom", "over", "under", "above", "below", "vertical", "horizontal", "clockwise", and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached", "coupled", "connected", and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about" or "substantially", which particularly means a deviation of ±10% from a reference value.

FIG. 1 shows an example of an electrodynamic acoustic transducer 1 in sectional view. The electrodynamic acoustic transducer 1 comprises a housing 2, a membrane 3 fixed to said housing 2, a coil 4 and a magnet system 5. The membrane comprises a bending section 6 and an optional rigid center plate 7. The coil 4 is attached to the membrane 3 and has an electrical conductor 8 in the shape of loops running around a coil axis X in a loop section A. The magnet system 5 comprises a center magnet 9, a pot plate 10 and a top plate 11 and is designed to generate a magnetic field B transverse to the conductor 8 in the loop section A. A current through the conductor 8 of the coil 4 causes the membrane 3 to move according to the electric signal applied to the coil 4.

Figure 2:
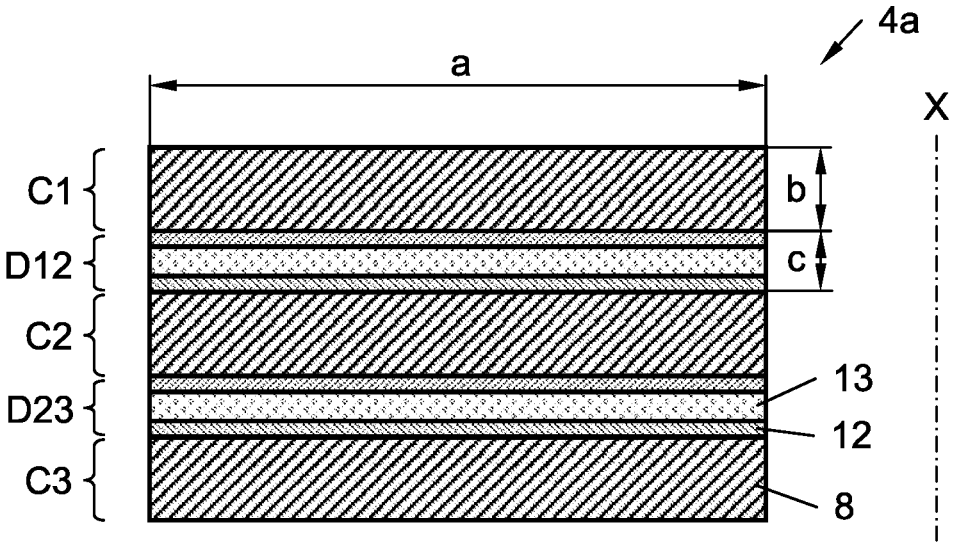
FIG. 2 shows detailed cross sectional view of an exemplary layer structure of a coil.

FIG. 2 shows an example of a coil 4*a* in more detail. In fact, FIG. 2 shows a cross sectional view with the coil axis X being part of the sectional plane. In other words, the sectional plane is perpendicular to a longitudinal extension of the electrical conductor 8 or perpendicular to a direction of a current flowing through the electrical conductor 8. The coil 4*a* in this cross sectional view comprises a plurality of conductive layers C1 . . . C3 formed by the electrical conductor 8 with insulation layers D12, D23 in-between. Note that the coil axis X is drawn much narrower to the coil 4*a* in FIG. 2 than the distance is in reality.

The longer side a of the rectangular cross section of the electrical conductor 8 (that is the width extension of the electrical conductor 8) in said cross sectional view is arranged perpendicular to the loop axis X. In other words, the longer side a is arranged in parallel with a field line of the magnetic field B through said conductor 8 or in parallel with the membrane 3 of the electrodynamic acoustic transducer 1. However, the angle between the longer side a of the rectangular cross section of the electrical conductor 8 and the coil axis X may also be in a range of 80° to 100°.

Preferably, the ratio between the longer side a of the rectangular cross section of the electrical conductor 8 and the smaller side b of the rectangular cross section of the electrical conductor 8 is >4. In other words, the ratio between the width of the electrical conductor 8 and its thickness preferably is >4.

In a further preferred embodiment, the thickness b of a conductive layer C1 . . . C3 is in a range of 10-30 μm. It is also of advantage, if a total thickness c of an insulation layer D12, D23 is in a range of 1-5 μm. In the example of FIG. 2, the insulation layer D12, D23 comprises an optional passivation layer 12, which is about 0.5-1.5 μm thick, and an adhesive 13 with a thickness of about 1-3 μm. Both the passivation 12 and the adhesive 13 form an insulation layer D12, D23.

For the sake of completeness it is noted that the conductive layers C1 . . . C3 are formed by a single electrical conductor 8, which helically runs around the coil axis X. The same counts for the insulation layer D12, D23. That however does not mean, that the electrical conductor 8 is necessarily made of a single piece of metal.

A method of manufacturing an electrodynamic acoustic transducer 1 comprises the steps of:

a) cutting the electrical conductor 8 out of a metallic foil,
b) forming an insulation layer D12, D23 on the electrical conductor 8,
c) making a stack of conductive layers C1 . . . C3 from the electrical conductor 8 and
d) (mechanically) connecting the conductive layers C1 . . . C3 to each other by means of an adhesive 13.

The metallic foil may be a copper foil or an aluminum foil or a foil made from an alloy based on copper or aluminum. Cutting in step a) may be done by means of a laser beam, a water jet, plasma cutting, photo etching, a knife or by punching for example. The passivation layer 12 preferably is a Boehmite layer, which is produced by exposing an electrical conductor 8 cut out of an aluminum (alloy) foil in step a) to hot distilled or de-ionized water and/or to hot vapor of distilled or de-ionized water.

Step c) can be done in different ways, which are explained later in more detail. First, making the stack of conductive layers C1 . . . C3 from the electrical conductor 8 may be done by stacking of separate pieces of the electrical conductor 8 and by electrically connecting the stacked separate pieces. Alternatively or in addition, making the stack of conductive layers C1 . . . C3 from the electrical conductor 8 may be done by folding the electrical conductor 8.

In a very advantageous embodiment, first the stack of conductive layers C1 . . . C3 is made from the electrical conductor 8 without an adhesive 13 and then an adhesive 13 is applied to the stacked electrical conductor 8. That means, the adhesive 13 is sucked into the gap between the conductive layers C1 . . . C3 by means of capillary action. In this way, the time for making the stack of conductive layers C1 . . . C3 is not limited by the curing time of the adhesive 13. Moreover, the stack of conductive layers C1 . . . C3 may be made in a very clean way. Superfluous adhesive 13 may be removed by means of a laser.

However, making the stack of conductive layers C1 . . . C3 may also be done by application of glue onto a first layer C1 or onto a passivation layer 12 of the electrical conductor 8, for example by spraying, pad printing or rolling, and by subsequently putting another layer C2 onto the adhesive layer D12. By repeating this sequence, a stack of any desired height can be produced. Alternatively, an insulating foil can be put onto the adhesive, which in turn is wetted with glue itself. Then a conductive layer C2 is put onto the glue of the insulating foil. In a further alternative, a single sided or double sided adhesive plastic foil may be used to build up a stack. If a double sided adhesive plastic foil is used, no further glue is to be applied at all. If a single sided adhesive plastic foil is used, additional glue is used on the non-adhesive side of the foil.

Figure 3:
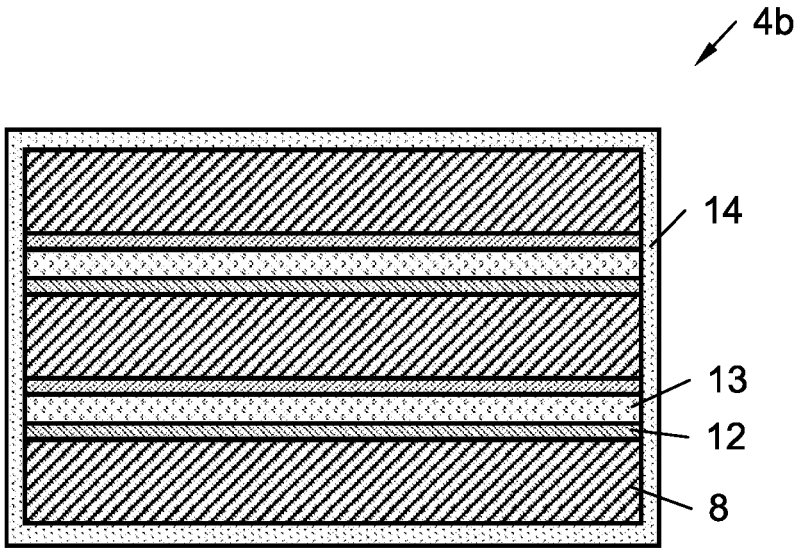
FIG. 3 shows the layer structure of FIG. 2 coated with an insulating material.

FIG. 3 shows an example of a coil 4*b*, which is quite similar to the coil 4*a* shown in FIG. 2. In contrast, the coil 4*b* is coated with an insulating material 14 after step d). In this way, the coil 4*b* is protected against short circuits and environmental influences.

Figure 4:
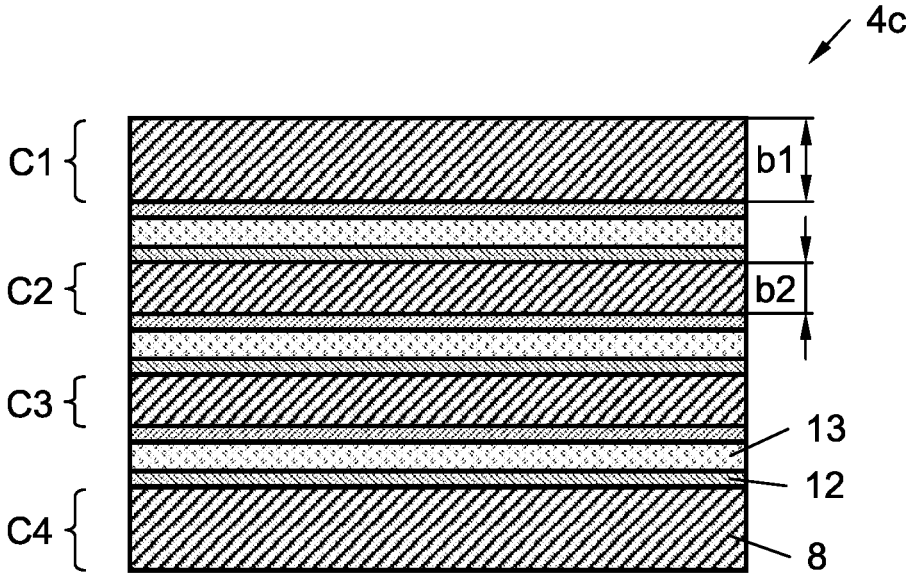
FIG. 4 shows a cross sectional view of an exemplary layer structure of a coil with thicker outer layers.

In the example of FIG. 2, the thickness b of the electrical conductor 8 is constant along the coil axis X. This however is no necessary condition, and the thickness b of the electrical conductor 8 may also vary along the coil axis X. FIG. 4 shows an example of a coil 4*c*, wherein the thickness b1 of a conductive layer C1, C4 forming an electrical connection of the coil 4*c* is thicker than the thickness b2 of an adjacent conductive layer C2, C3. In the example of FIG. 4, the conductive layers C1, C4 forming electrical connections of the coil 4*c* are the outer conductive layers C1, C4 what means that the coil 4*c* has two electrical connections. Accordingly, a conductive layer C1, C4 forming an electrical connection of the coil 4*c* has only one adjacent conductive layer C2, C3.

Figure 5:
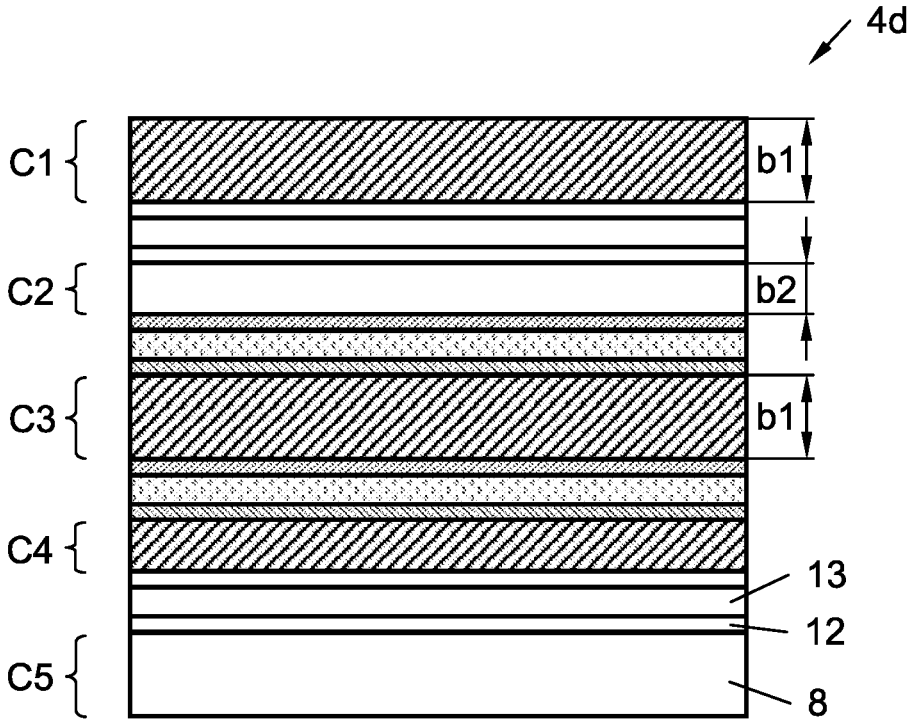
FIG. 5 shows a layer structure similar to the one of FIG. 4, but with an additional thicker middle layer.

FIG. 5, shows an example of another coil 4*d*, which is similar to the coil 4*c* of FIG. 4. In contrast, the coil 4*d* has an additional, middle conductive layer C3 forming an electrical connection of the coil 4*d*, the thickness b1 of which is thicker than the thickness b2 of an adjacent conductive layer C2, C4. In the example of FIG. 5, the conductive layers C1, C3, C5 form electrical connections of the coil 4*d* what means that the coil 4*d* has three electrical connections. Accordingly, the conductive layer C3 forming the electrical middle connection of the coil 4*d* has two adjacent conductive layers C2, C4.

Figure 6:
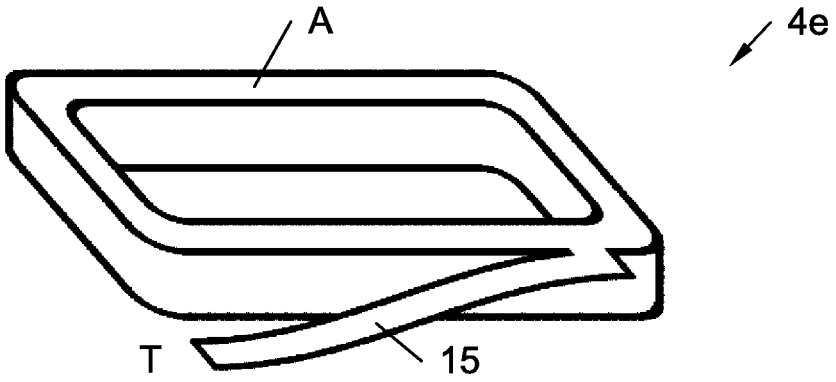
FIG. 6 shows a perspective view of an exemplary coil with a conductive layer forming a connection to a fixed terminal of the electrodynamic acoustic transducer.

A conductive layer C1 may also (directly) form an electrical connection 15 between the coil 4*e* (in detail its loop section A) and a non-moving terminal T of the electrodynamic acoustic transducer 1 as this is shown in FIG. 6. The non-moving terminal T may be fixed to the housing 2 or a frame of the electrodynamic acoustic transducer 1 and form an external terminal T. However, the non-moving terminal T may also be connected to an external terminal by means of an additional conductor. Advantageously, no dedicated wires are needed to connect the loop section A of the coil 4*e* to the non-moving terminal T. Moreover, the conductive layer C1 has excellent bending characteristics in the direction of the loop axis X and thus in the moving direction of the membrane 3. In other words, the conductive layer C1 forming the electrical connection 15 between the coil 4*e* and a non-moving terminal T is very soft against bending in the moving direction of the membrane 3 and does not much hinder the membrane's movement.

Figure 7:
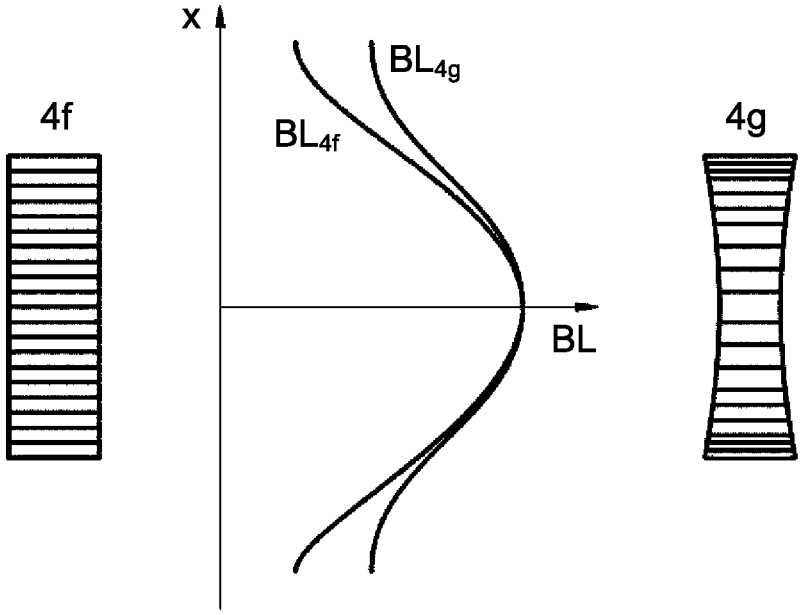
FIG. 7 shows an example how the driving force factor can be flattened by use of the proposed measures.

FIG. 7 shows another reason for varying the thickness b of the electrical conductor 8 along the coil axis X. In detail, FIG. 7 shows a coil 4*f* with constant thickness b and width a of the conductive layers C1 . . . C5 on the left side and a coil 4*g* with varying thickness b and width a of the conductive layers C1 . . . C5 on the right side. Moreover, the graph of the driving force factor BL over the membrane excursion x is shown in the middle.

In this example, a variation of the thickness b of a conductive layer C1 . . . C5, which corresponds to the length of the shorter side of the rectangular cross section of the conductor 8, is done in a way that the driving force factor $BL_{4g}$ of a transducer 1 with the right coil 4*g* is flattened compared to the driving force factor $BL_{4f}$ of a transducer 1 with the left coil 4*f* with non-varied thickness b of the conductive layers C1 . . . C5. In fact, the thickness b of the conductive layer C1 . . . C5 (i.e. the shorter side of the rectangular cross section of the electrical conductor 8) of the right coil 4*g* is larger in a center region of the coil 4*g* than in a distant region for that reason.

Moreover, a variation of the width a of a conductive layer C1 . . . C5, which corresponds to the length of the longer side of the rectangular cross section of the electrical conductor 8, can be done in a way that the cross sectional area of the electrical conductor 8 and thus the current density in the electrical conductor 8 is kept constant or substantially constant throughout the height of the coil 4*g*. In fact, the width a of the conductive layer C1 . . . C5 (i.e. the longer side of the rectangular cross section of the electrical conductor 8) of the right coil 4*g* is smaller in a center region of the coil 4*g* than in a distant region for that reason.

Alternatively or in addition, the horizontal position of a center of the longer side a of the rectangular cross section of the electrical conductor 8 may vary along the coil axis X. In this way, the coil 4*g* gets an asymmetrical shape.

Figure 8:
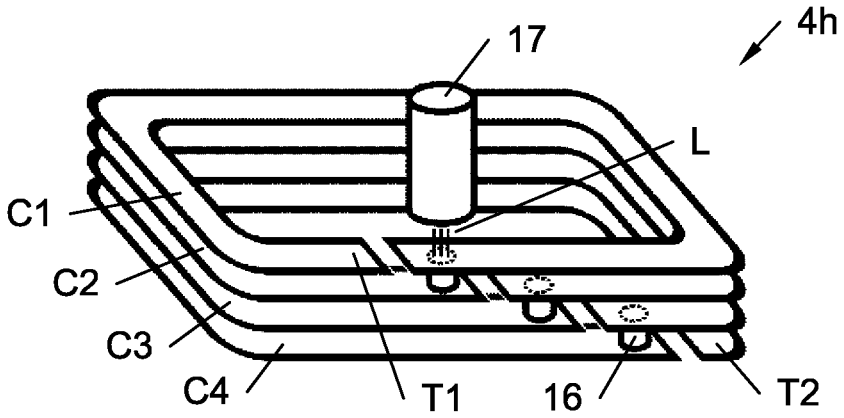
FIG. 8 shows a perspective view of an exemplary coil built up by separate pieces of a conductive layer.

As mentioned hereinbefore, making a stack of conductive layers C1 . . . C4 from the electrical conductor 8 may be done by stacking of separate pieces of the electrical conductor 8 and by electrically connecting the stacked separate pieces in step c). An example for such a procedure is shown in FIG. 8. In detail, the separate pieces of the electrical conductor 8 (i.e. foil blanks cut from a foil sheet) are electrically connected by means of laser welding or ultrasonic welding in step c). For that reason, welding joints 16 between the conductive layers C1 . . . C4 are made by use of a laser beam L of a laser 17. Preferably, the laser power is set to a level, at which it cracks a passivation layer 12 or even a complete insulation layer D12, D23 if it is already applied and welds together only two conductive layers C1 . . . C4 without destroying the passivation layer 12 or insulation layer D12, D23 offside the welding joint 16. Moreover, it is advantageous if the welding joints 16 between the different conductive layers C1 . . . C4 are spaced or offset along the course of the electrical conductor 8 as this is shown in FIG. 8.

Figure 9:
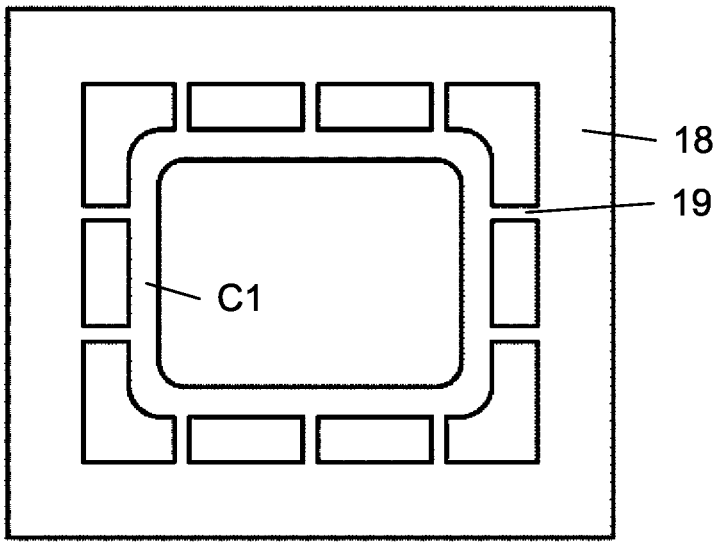
FIG. 9 shows a top view on a conductive layer with a supporting structure.

Because auf the small cross section of the electrical conductor 8, handling a conductive layer C1 . . . C5 may get tricky because of its flimsy structure. For this reason, a supporting structure 18 connected to the electrical conductor 8 by means of bars 19 may be cut out of a metallic foil in step a) as this is shown in the example of FIG. 9. In detail, the supporting structure 18 consists of a comparably broad frame, which is connected to the conductive layer C1 by means of several bars 19. The supporting structure 18 together with the bars 19 is removed from the electrical conductor 8 after step d), i.e. after the conductive layers C1 . . . C5 have been interconnected mechanically by means of an adhesive thus stabilizing the layer structure and making the supporting structure 18 superfluous.

It is of advantage in this context if the bars of adjacent conductive layers C1 . . . C5 are located at different positions after step c) when viewed in a direction of the loop axis X. In other words, the bars 19 are not stacked when the conductive layers C1 . . . C5 are stacked, but the bars 19 of adjacent conductive layers C1 . . . C5 are displaced to each other. In this way, removing the bars 19 after step d) is eased. They may be cut away by means of the laser 17 or may simply be torn off.

Figure 10:
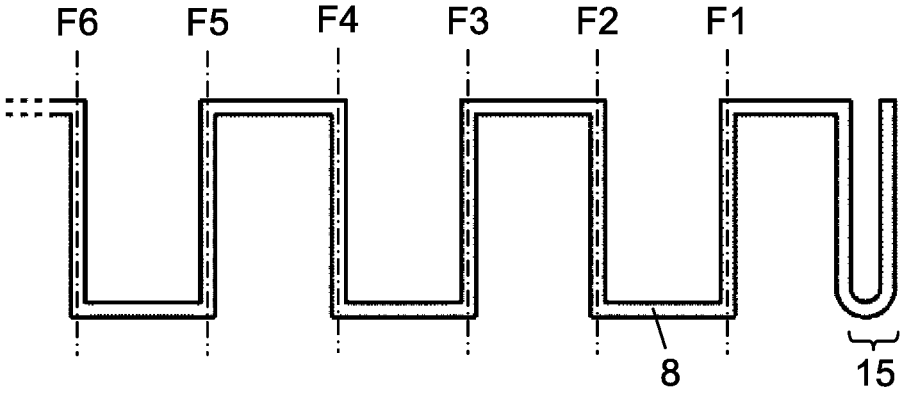
FIG. 10 shows a top view on an electrical conductor with a wave like or meander like shape in the unfolded state.

Making a stack of conductive layers C1 . . . C4 by stacking of separate pieces of the electrical conductor 8 is not the only possibility. Making a stack of conductive layers C1 . . . C4 from the electrical conductor 8 may also be done by folding the electrical conductor 8. FIG. 10 shows an electrical conductor 8 cut out of a metal foil in the shape of a rectangular wave or in the shape of a meander. In a second step, the electrical conductor 8 is folded in a zigzag fashion or accordion fashion along the folding lines F1 . . . F6. In this way, the electrical conductor 8 in the end helically runs around the coil axis X thus forming the loop section A of a coil 4 . . . 4*h*.

In this example, the foil blank also comprises an optional section, which later forms the electrical connection 15 or lead between the loop section A of the coil 4 and the non-moving terminal T of the electrodynamic acoustic transducer 1. In other words, the leads 15 of the coil 4 may integrally be formed with the loop section A and may be cut out of the metal foil together with a conductive layer C1 . . . C5 in a single step. In a preferred embodiment, a portion of the metal foil sheet can be covered with a coating prior to cutting the leads 15 to improve performance of the same. For example, a polyamide coating may be deposited on a portion of the metal foil sheet in which the lead 15 are arranged. The polyamide coating improves fatigue performance and/or provides corrosion resistance, which may lead to increased service life of a electrodynamic acoustic transducer 1 incorporating such a coil 4. However, it should be noted that coating the leads 15 prior to cutting is no necessary condition, and the leads 15 may also be coated after the cutting step.

It should be noted that folding the electrical conductor 8 is different to wind an electrical conductor 8. "Folding" means bending the (flat) electrical conductor 8 by 180° so that again a flat structure is formed. "Winding" means bending an electrical conductor 8 continuously so that a round coil is formed or making ongoing bends of <180° in the same direction so that a polygonal coil is formed.

In the example shown in FIG. 10, the bends around the folding lines F1 . . . F6 are arranged in the course of the legs of a polygonal coil 4 . . . 4*h*. However, the bends may also be arranged outside of the course of the legs of a polygonal coil 4 . . . 4*h*. In detail, at least two conductive layers C1 . . . C5 or loops can be formed by a single piece of a metallic foil, which comprises a bend between each two conductive layers C1 . . . C5, wherein the bend is arranged in a protrusion or jogged portion of the coil 4 . . . 4*h*.

Figure 11:
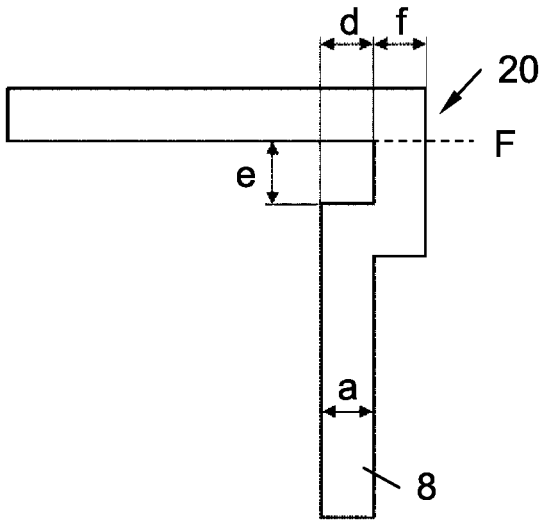
FIG. 11 shows a top view on a protrusion in the corner of an electrical conductor in the unfolded state.
Figure 12:
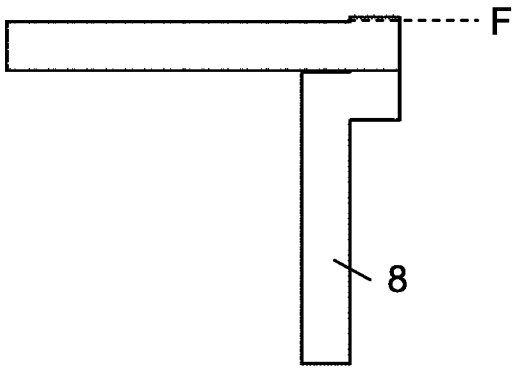
FIG. 12 shows a top view on the electrical conductor of FIG. 11 in the folded state.
Figure 13:
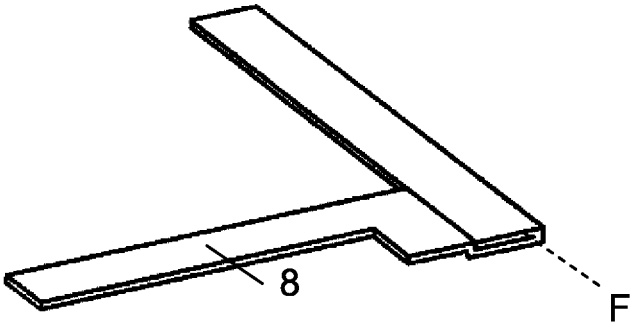
FIG. 13 shows a perspective view of the folded electrical conductor of FIG. 12.
Figure 14:
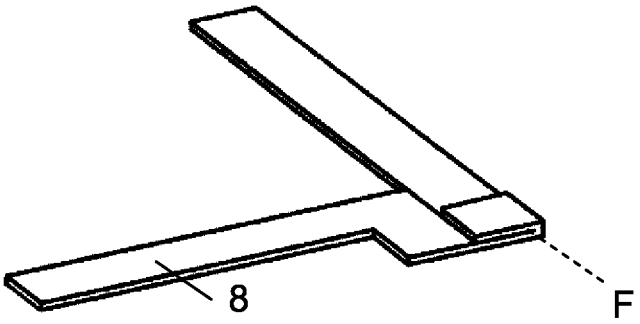
FIG. 14 shows a perspective view of an alternative method of folding the electrical conductor of FIG. 11.

FIGS. 11 to 14 show examples of an electrical conductor 8 with such a protrusion 20. FIG. 11 shows the (unbent) corner region of an electrical conductor 8 cut out of a metal foil. FIG. 12 shows a top view of the folded electrical conductor 8. FIG. 13 shows an oblique view of a first example of the folded electrical conductor 8, and FIG. 14 shows an oblique view of a second example of the folded electrical conductor 8.

As is shown in FIGS. 11 to 14, the bend along the folding line F is arranged outside of the course of the legs of the polygonal coil 4 . . . 4*h*. In detail, the electrical conductor 8 in the region of the protrusion 20 runs out of the plane of the conductive layer C1 . . . C5 by at least the thickness b of the conductive layer C1 . . . C5 in a section from a protrusion 20 start to the folding line F. In the example of FIG. 13, there is a step down out of the plane of the leg coming from the lower left side. In the example of FIG. 14, there is a step up out of the plane of the leg coming from the upper left side.

In addition, the electrical conductor 8 in the region of the protrusion 20 runs along a 180° bending around the folding line F back into the plane of the conductive layer C1 . . . C5. In the example of FIG. 13, electrical conductor 8 is fold upwards back in the plane of the conductive layer C1 . . . C5. In the example of FIG. 14, electrical conductor 8 is fold downwards back in the plane of the conductive layer C1 . . . C5.

However, there may also be a step up out of the plane of the leg coming from the lower left side and a 180° fold downwards back in the plane of the conductive layer C1 . . . C5 in the example of FIG. 13 and a step down out of the plane of the leg coming from the upper left side and a 180° fold upwards back in the plane of the conductive layer C1 . . . C5 in the example of FIG. 14.

In all cases, a portion having twice the thickness b of an electrical conductor 8 is arranged in the protrusion 20 and outside of the course of the legs of the polygonal coil 4 . . . 4*h*. Accordingly, each conductive layer C1 . . . C5 is an even structure in the course of the legs of the polygonal coil 4 . . . 4*h*, and the conductive layers C1 . . . C5 can be stacked easily. In this example, said portions having twice the thickness b of an electrical conductor 8 appear in every second corner. However, this is no necessary condition, and other patterns are possible as well.

To provide the above benefits, the dimensions d and e should be equal to or even exceed the width a of the electrical conductor 8. In other words, d≥a and e≥a. When setting the dimension e, also an additional length for enabling the fold should be considered. So, preferably e≥d.

It should be noted that the shape of the protrusions 20 depicted in FIGS. 11 to 14 is just exemplary, and other shapes can provide the above benefits as well. In particular, the protrusions 20 may be rounded or can exclusively be made up from round shapes.

Figure 15:
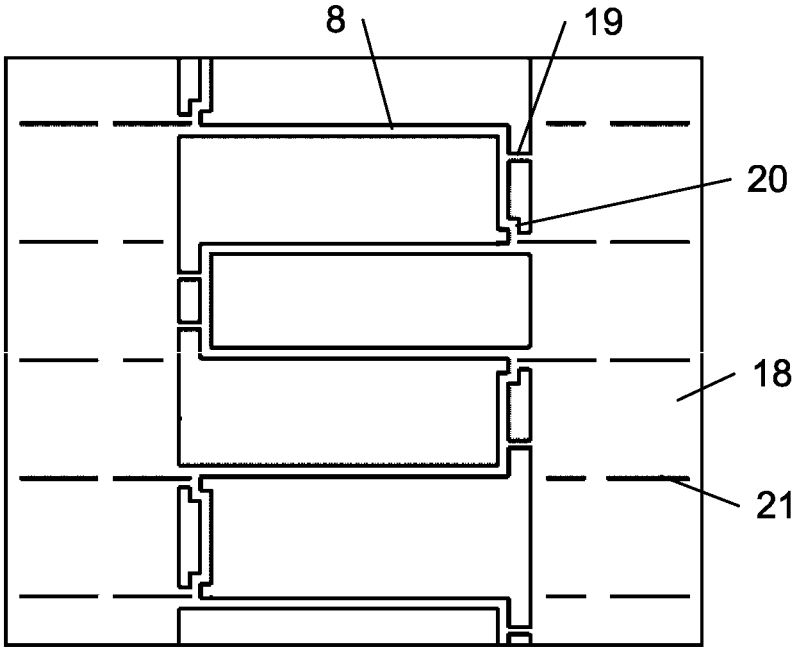
FIG. 15 shows a top view of an exemplary supporting structure for an electrical conductor with a wave like or meander like shape.
Figure 16:
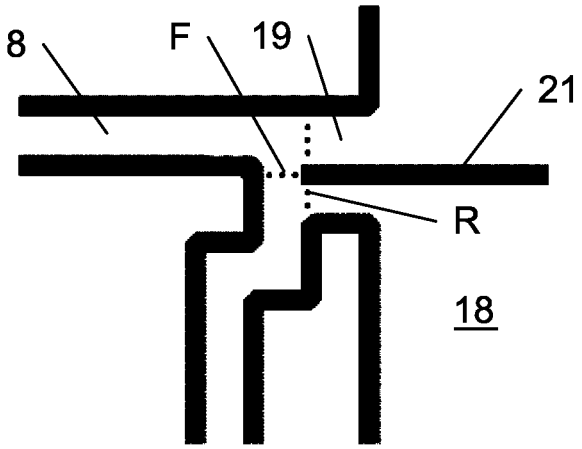
FIG. 16 shows a detailed top view of the structure depicted in FIG. 15 in the corner region.
Figure 17:
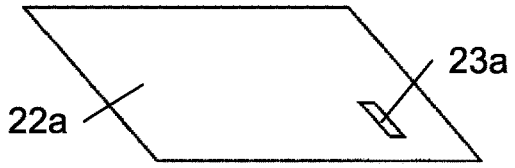
FIGS. 17 to 22 show variants of the proposed manufacturing method, in which the contour of the coil is cut out after a number of foil blanks have been stacked.

FIGS. 15 and 16 show an example of a supporting structure 18 for the electrical conductor 8 having the shape of a rectangular wave or the shape of a meander like the electrical conductor 8 of FIG. 10 and the protrusions 20 shown in FIGS. 12 to 14. FIG. 15 shows an example with a couple of legs of the wave structure or meander structure, and FIG. 16 shows a detailed view of an protrusion 20. Said supporting structure 18 reduces or eliminates twisting or deformation of the electrical conductor 8 when handling the same, in particular during the folding step.

Again, the electrical conductor 8 is connected to the supporting structure 18 by means of bars 19, and again the supporting structure 18 together with the bars 19 is removed from the electrical conductor 8 after step d), i.e. after the structure has been folded and the conductive layers C1 . . . C5 have been interconnected mechanically by means of an adhesive thus stabilizing the layer structure and making the supporting structure 18 superfluous. To ease folding, a number of cut outs 21 are arranged in the supporting structure 18 along the folding lines F thus forming a perforation. Due to cut outs 21 along the folding lines F in the blank, the electrical conductor 8 folds at the desired folding lines F when lifted. To ease folding, alternatively or in addition, an indentation or groove can be formed along a folding line F before step c). The indentation can be formed with a laser at low laser power, by etching or by embossing.

FIG. 15 furthermore shows, that the bars 19 are located at different positions after step c) when viewed in a direction of the loop axis X after the folding step. In this way, removing the bars 19 after step d) is eased. They may be cut away by means of the laser 17 or may simply be torn off. To ease tearing off the bars 19, a number of cut outs can be arranged along a tear off line R, along which the bar 19 finally is torn off, thus forming a perforation. To ease tearing off the bars 19, alternatively or in addition, also an indentation or groove can be formed along a tear off line R. Again, the indentation can be formed with a laser at low laser power, by etching or by embossing. It should be noted that the perforation and the indentations or grooves equally apply to the bars 19 shown in FIG. 9.

It should be noted at this point that making a stack of conductive layers C1 . . . C5 for a single coil 4 can be done by folding of the electrical conductor 8 and by stacking of separate pieces of the electrical conductor 8, which are electrically connected. That means that separate folded electrical conductors 8 may be stacked and electrically connected or folded electrical conductors 8 may be combined (stacked) with unfolded pieces of the electrical conductor 8.

The folds in the electrical conductors 8 can lead to an increased electrical resistance in the region of the folds which can impact the acoustic performance of the electrodynamic acoustic transducer 1. This resistance increase may be compensated by increasing the width f of the electrical conductors 8 in the region of the folding lines F (see FIG. 11 in this context). In turn, a larger cross-sectional area for the electrical current to flow through is provided, which thus reduces the electrical resistance. However, if aluminum is used for the electrical conductor 8, it may be hardened and locally annealed by the laser 15 in the region of the folds what reduces the electrical resistance as well. In this way, the width f of the electrical conductor 8 in the region of the folding lines F does not need to be increased as there is little to no increase of the resistance as a result of the folding.

Figure 18:
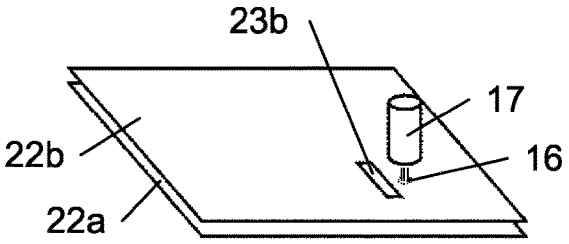
Figure 19:
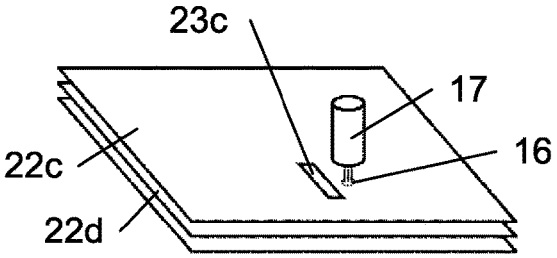
Figure 20:
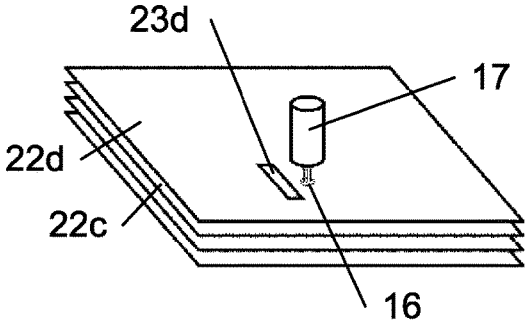
Figure 21:
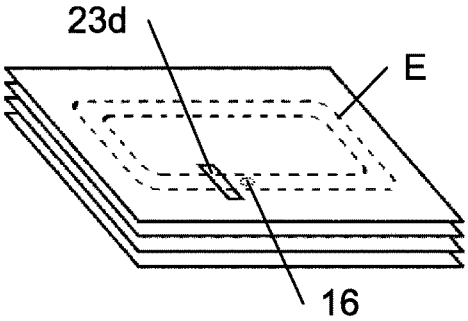
Figure 22:
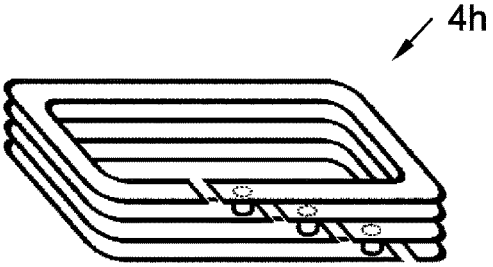

FIGS. 17 to 22 show an alternative method of manufacturing the coil 4*h* being depicted in FIG. 8. The method is similar to the one explained in the context with FIG. 8, but the cutting step a) takes place after step d) here. In detail, a first piece of a metal foil 22*a* is provided in a first step shown in FIG. 17. The metal foil 22*a* comprises a cut out 23*a* at the position, where the electrical conductor 8 is separated later. In FIG. 18 a further piece of a metal foil 22*b* has been put onto the metal foil 22*a*. The metal foil 22*b* comprises a cut out 23*a* at the position, where the electrical conductor 8 is separated later, too. The laser 17 makes a welding joint 16 to electrically connect the metal foil 22*a* and the metal foil 22*b* at the position indicated in FIG. 18. The same sequence is performed for a metal foil 22*c* in FIG. 19 and a metal foil 22*d* in FIG. 20. As can be seen, the cut outs 23*a* . . . 23*d* in the metal foils 22*a* . . . 22*d* are displaced in horizontal direction. As a result, a stack of metal foils 22*a* . . . 22*d*, which are electrically connected by welding joints 16 at dedicated positions, is generated. This stack is shown in FIG. 21. In a further step a coil contour E is cut out of the stack of metal foils 22*a* . . . 22*d*, e.g. by means of the laser 17, a water jet, plasma cutting, photo etching, a knife or by punching. Hence, a number of conductive layers C1 . . . C5 are cut simultaneously in step a). Finally, the coil 4*h*, which is already shown in FIG. 8, is generated as depicted in FIG. 22. In FIGS. 17 to 22 the cutting step a) takes place after step d), whereas in the description of FIG. 8 the cutting step a) takes place before step d). In yet another embodiment, the cutting step a) can take place after step c), but before step d).

Generally, the metal foils 22*a* . . . 22*d* may have been passivated before they are used to build up a stack. Again, the stack can be build up of "dry" pieces of the metal foils 22*a* . . . 22*d*, between which an adhesive 13 is applied and sucked into the gap between the metal foils 22*a* . . . 22*d* by means of capillary action. This can be done for each two pieces or once for the whole stack. But, making the stack of the metal foils 22*a* . . . 22*d* may also be done by application of glue onto a first metal foil 22*a* or onto a passivation layer 12 of the metal foil 22*a*, for example by spraying, pad printing or rolling, and by subsequently putting another metal foil 22*b* onto the adhesive layer D12. Alternatively, an insulating foil can be put onto the adhesive, which in turn is wetted with glue itself. Then the metal foil 22*b* is put onto the glue on the insulating foil. In a further alternative, a single sided or double sided adhesive plastic foil may be used to build up the stack. In this embodiment, the adhesive plastic foil is applied onto the first metal foil 22*a*, and the next metal foil 22*b* is applied onto the adhesive plastic foil. If a double sided adhesive plastic foil is used, no further glue is to be applied at all. If a single sided adhesive plastic foil is used, additional glue is used on the non-adhesive side of the foil. By repeating the given sequences, a stack of any desired height can be produced.

Figure 23:
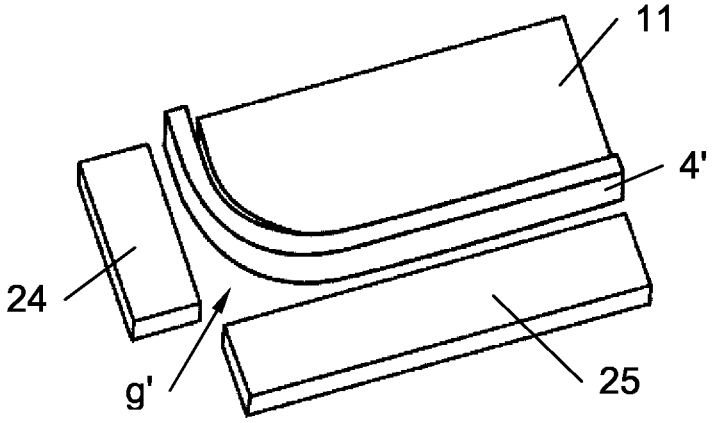
Fig. 23 (prior art)
FIG. 23 shows a perspective view of a prior art drive system in its corner region.
Figure 24:
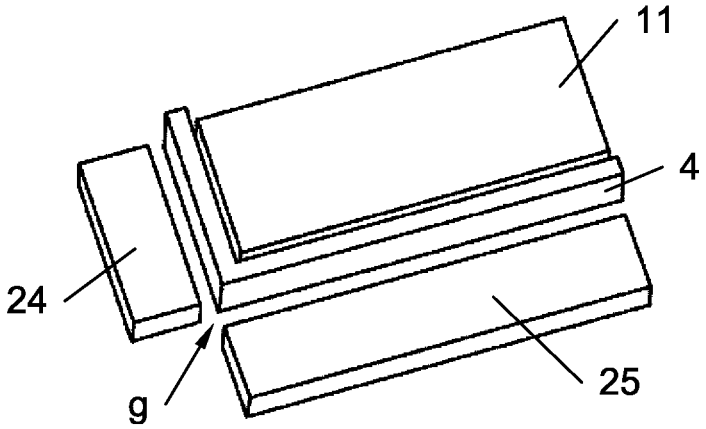
FIG. 24 shows a perspective view of a drive system of the proposed kind in its corner region.

Finally, FIGS. 23 and 24 illustrate the influence of the coil shape on the output power of the electrodynamic acoustic transducer 1. In detail, FIG. 23 shows the corner region of a prior art drive system, which comprises a center plate 11, separate, linear side magnets 24, 25 and a coil 4' with rounded corners, and FIG. 24 shows the corner region of a proposed drive system, which comprises a center plate 11, separate, linear side magnets 24, 25 and a coil 4 with sharp corners. When FIGS. 23 and 24 are compared, it gets clear that the air gap g of the proposed drive system in FIG. 24 is substantially smaller in the corner region than the air gap g' of the prior art drive system of FIG. 23. Accordingly, a transducer 1 using the proposed drive system of FIG. 24 provides more sound power than the prior art drive system of FIG. 23. In other words, the proposed drive system of FIG. 24 is more efficient that the prior art drive system of FIG. 23.

In summary, the proposed method provides coils 4 . . . 4*h* with a high density of the electrical conductor 8. Preferably, a fill factor, which is the share of all conductive layers C1 . . . C5 on the volume of the coil 4 . . . 4*h* is >80%. Other solutions, like coils with a coil wire or horizontally stacked layers provide a fill factor which is much lower thus downgrading the power weight ratio of a coil 4 . . . 4*h*. Moreover, a tensile stress in the electrical conductor 8 preferably can be kept below 50 $N/mm^2$ during steps a) to d) so as to avoid a belly-shape or bone-shape, which normally occurs when a wire is wound to a coil 4 . . . 4*h*.

It should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention.

The scope of the present invention is defined by the appended claims, including known equivalents and unforeseeable equivalents at the time of filing of this application. Although numerous embodiments of this invention have been described above with a certain degree of particularity, those skilled in the art could make numerous alterations to the disclosed embodiments without departing from the spirit or scope of this disclosure.

| LIST OF REFERENCES | |
|---|---|
| 1 | electrodynamic acoustic transducer |
| 2 | housing |
| 3 | membrane |
| 4, 4' 4a . . . 4g | coil |

-continued

| LIST OF REFERENCES | |
|---|---|
| 5 | magnet system |
| 6 | bending section |
| 7 | rigid center plate |
| 8 | electrical conductor |
| 9 | center magnet |
| 10 | pot plate |
| 11 | top plate |
| 12 | passivation layer |
| 13 | adhesive |
| 14 | coating |
| 15 | electrical connection to non-moving terminal |
| 16 | welding joint |
| 17 | laser |
| 18 | supporting structure |
| 19 | bar |
| 20 | protrusion/jogged portion |
| 21 | cut out |
| 22a . . . 22d | metal foil |
| 23a . . . 23d | cut out |
| 24 | side magnet |
| 25 | side magnet |
| a | width of the conductive layer (longer side) |
| b, b1, b2 | thickness of the conductive layer (shorter side) |
| c | (total) thickness of insulation layer |
| d | displacement of electrical conductor |
| e | displacement of electrical conductor |
| f | width of electrical conductor in the fold region |
| g, g' | air gap |
| x | excursion |
| A | loop section |
| B | magnetic field |
| BL | driving force factor |
| C1 . . . C5 | conductive layer |
| D12, D23 | insulation layer |
| E | coil contour |
| F, F1 . . . F6 | folding line |
| R | tear off line |
| T, T1, T2 | non-moving terminal |
| X | coil axis |

What is claimed is:

1. A method of manufacturing an electrodynamic acoustic transducer with a frame and/or a housing, a membrane fixed to said frame or said housing, at least one coil, which is attached to the membrane and which has an electrical conductor in the shape of loops running around a coil axis in a loop section, and a magnet system being designed to generate a magnetic field transverse to the conductor in the loop section, comprising the steps of:

a) cutting the electrical conductor and a supporting structure out of a metallic foil, wherein the supporting structure is connected to the electrical conductor by a plurality of bars;

b) forming an insulation layer on the electrical conductor;

c) making a stack of conductive layers from the electrical conductor by stacking of separate pieces of the electrical conductor and electrically connecting the stacked separate pieces;

d) connecting the conductive layers to each other by means of an adhesive; and e) removing the supporting structure and bars from the electrical conductor.

2. The method as claimed in claim 1, characterized in that the electrical conductor is cut out of an aluminum foil in step a) and a passivation layer, which is part of the insulation layer, is formed on the electrical conductor by exposing the electrical conductor to hot distilled or de-ionized water and/or to hot vapor of distilled or de-ionized water.

3. The method as claimed in claim 1, characterized in that the conductive layer is cut by means of a laser beam or a water beam in step a).

4. The method as claimed in claim 1, characterized in that the separate pieces of the electrical conductor are electrically connected by means of laser welding or ultrasonic welding in step c).

5. The method as claimed in claim 1, characterized in that first the stack of conductive layers is made from the electrical conductor without an adhesive and then an adhesive is applied to the stacked electrical conductor.

6. The method as claimed in claim 5, characterized in that superfluous adhesive is removed by means of a laser.

7. The method as claimed in claim 1, characterized in that the bars of adjacent conductive layers are located at different positions after step c) when viewed in a direction of the loop axis.

8. The method as claimed in claim 1, characterized in that the coil is coated with an insulating material after step d).

9. The method as claimed in claim 1, characterized in that tensile stress in the electrical conductor is kept below 50 $N/mm^2$ during steps a) to d).

10. The method as claimed in claim 1, characterized in that an indentation is formed along a tear off line of a bar connecting the electrical conductor to a supporting structure.

11. A method of manufacturing an electrodynamic acoustic transducer with a frame and/or a housing, a membrane fixed to said frame or said housing, at least one coil, which is attached to the membrane and which has an electrical conductor in the shape of loops running around a coil axis in a loop section, and a magnet system being designed to generate a magnetic field transverse to the conductor in the loop section, comprising the steps of:

a) cutting the electrical conductor out of a metallic foil;
b) forming an insulation layer on the electrical conductor;
c) making a stack of conductive layers from the electrical conductor by folding of the electrical conductor; and
d) connecting the conductive layers to each other by means of an adhesive.

12. The method as claimed in claim 11, characterized in that an indentation is formed along a folding line, around which the electrical conductor is to be folded, before step c).

* * * * *